US010760459B2

(12) United States Patent
Foerster et al.

(10) Patent No.: US 10,760,459 B2
(45) Date of Patent: Sep. 1, 2020

(54) OIL SUPPLY SYSTEM FOR AN INTERNAL COMBUSTION ENGINE

(71) Applicant: INNIO Jenbacher GmbH & Co OG, Jenbach, Tiro, I (AT)

(72) Inventors: Michael Foerster, Gablingen (DE); Alfred Herbert Rangger, Kramsach (AT)

(73) Assignee: INNIO JENBACHER GMBH & CO OG, Jenbach (AT)

( * ) Notice: Subject to any disclaimer, the term of this patent is extended or adjusted under 35 U.S.C. 154(b) by 70 days.

(21) Appl. No.: 15/737,603

(22) PCT Filed: Jun. 20, 2016

(86) PCT No.: PCT/AT2016/050213
§ 371 (c)(1),
(2) Date: Dec. 18, 2017

(87) PCT Pub. No.: WO2016/205844
PCT Pub. Date: Dec. 29, 2016

(65) Prior Publication Data

US 2019/0203618 A1 Jul. 4, 2019

(30) Foreign Application Priority Data

Jun. 25, 2015 (AT) ..... A 50551/2015

(51) Int. Cl.
*F01M 11/06* (2006.01)
*F01M 11/04* (2006.01)
*F01M 11/00* (2006.01)

(52) U.S. Cl.
CPC ..... *F01M 11/061* (2013.01); *F01M 11/04* (2013.01); *F01M 11/0458* (2013.01);
(Continued)

(58) Field of Classification Search
CPC ..... F01M 11/061; F01M 11/0458; F01M 2011/0095
See application file for complete search history.

(56) References Cited

U.S. PATENT DOCUMENTS 2,456,886 A 12/1948 Mori
2,946,328 A * 7/1960 Mettetal, Jr. ..... F01M 11/061 123/196 R
(Continued)

FOREIGN PATENT DOCUMENTS

CN 1387000 A 12/2002
CN 201730653 U 2/2011
(Continued)

OTHER PUBLICATIONS

"SBZ Monteur," Retrieved from the Internet URL: http://www.sbz-monteur.de/, on May 18, 2018, pp. 1-3 (May 17, 2018).
(Continued)

*Primary Examiner* — Syed O Hasan
(74) *Attorney, Agent, or Firm* — Fletcher Yoder, P.C.

(57) ABSTRACT

Oil supply system for an internal combustion engine, whereby an internal oil pan is arranged in the internal combustion engine, whereby the oil supply system has an additional external oil reservoir which is arranged outside the internal combustion engine compared to the internal oil pan of the internal combustion engine, whereby a supply line to be connected to the internal combustion engine is provided, which leads to a filling opening of the oil reservoir, and whereby a return line to be connected to the internal combustion engine is provided, through which oil can be returned from the oil reservoir to the internal combustion engine, whereby the return line is connected to the oil reservoir and whereby the oil reservoir has at least one oil
(Continued)

tank, whereby a removal opening of the return line is arranged near or in the base of the at least one oil tank.

20 Claims, 1 Drawing Sheet

(52) U.S. Cl.
CPC ..... *F01M 2011/0095* (2013.01); *F01M 2011/0466* (2013.01)

(56) References Cited

U.S. PATENT DOCUMENTS

| | | | | |
|---|---|---|---|---|
| 3,722,624 | A | 3/1973 | Buckland | |
| 6,283,082 | B1 | 9/2001 | Gunshore et al. | |
| 2005/0022756 | A1* | 2/2005 | Novlan | F01M 11/03 123/73 AD |
| 2013/0001017 | A1* | 1/2013 | Saenz de Ugarte Sevilla | F03D 80/70 184/6.12 |
| 2014/0209053 | A1* | 7/2014 | Norrick | F01M 11/061 123/196 R |

FOREIGN PATENT DOCUMENTS

| | | | | |
|---|---|---|---|---|
| CN | 202914158 | U | | 5/2013 |
| CN | 203442457 | U | | 2/2014 |
| CN | 103670590 | A | | 3/2014 |
| CN | 203962085 | U | | 11/2014 |
| DE | 196 19 843 | A1 | | 11/1997 |
| DE | 101 24 476 | A1 | | 12/2002 |
| DE | 10 2007 033 419 | A1 | | 1/2009 |
| JP | 6375306 | A | | 4/1988 |
| JP | H02-204609 | A | | 8/1990 |
| JP | H02204609 | | * | 8/1990 |
| JP | H06-336908 | A | | 12/1994 |

OTHER PUBLICATIONS

Search Report issued in connection with corresponding AT Application No. A505512015 dated May 13, 2016.

Machine Translation and International Preliminary Report on Patentability issued in connection with corresponding PCT Application No. PCT/AT2016/050213 dated Dec. 26, 2017.

Chinese First Office Action for CN Application No. 201680037034.5 dated Apr. 25, 2019; 13 pgs.

* cited by examiner

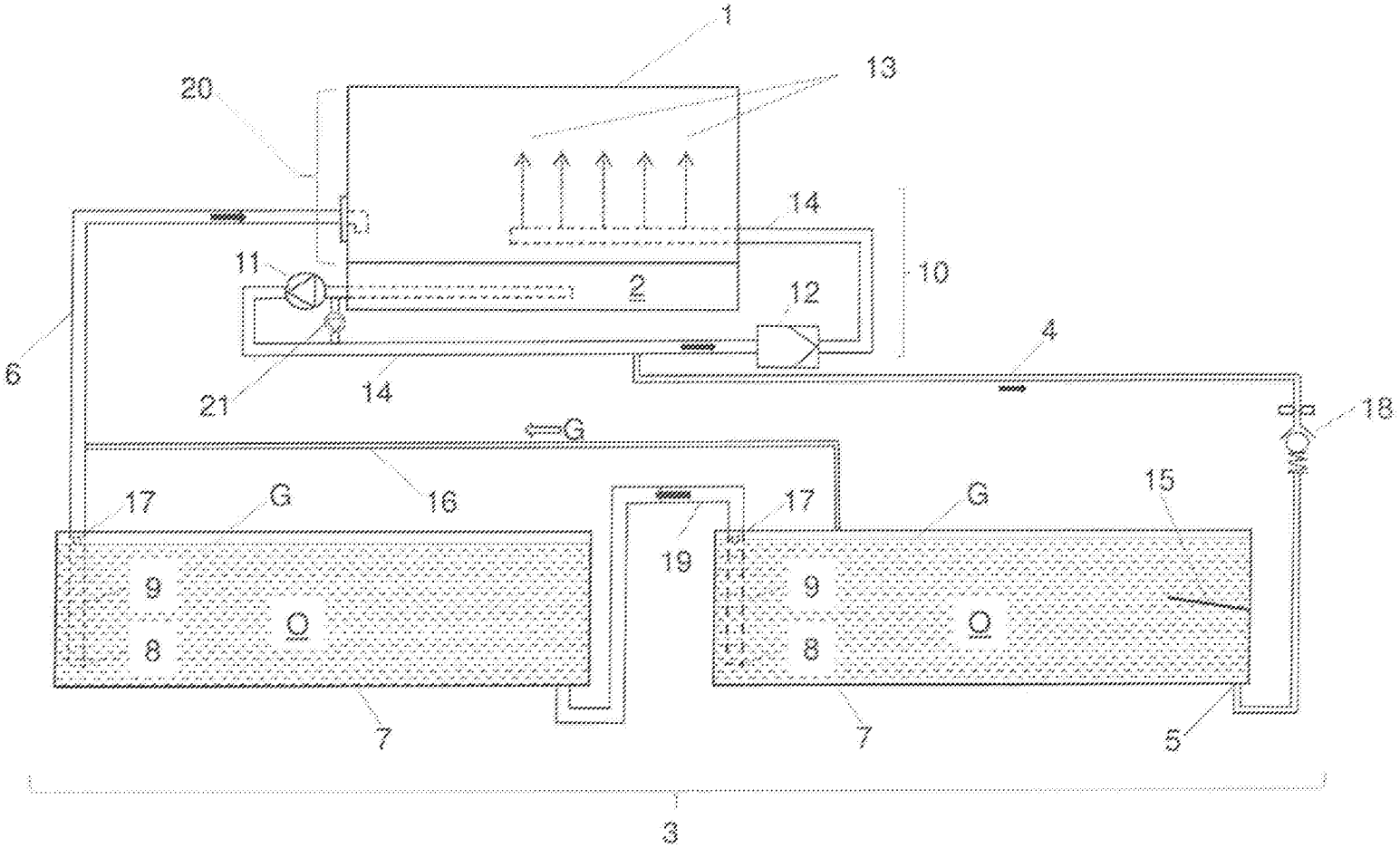
1
2
3
4
5
6
7
8
9
10
11
12
13
14
15
16
17
18
19
20
21
G
G
O
O

OIL SUPPLY SYSTEM FOR AN INTERNAL COMBUSTION ENGINE

The invention relates to an oil supply system for an internal combustion engine with the features of the preamble of claim 1.

In the case of oil supply systems for internal combustion engines known from the prior art, in a forced-feed lubrication, oil from an internal oil pan of the internal combustion engine is pumped to the consumers by an oil pump and is returned to the internal oil pan of the internal combustion engine under the influence of the gravity. It is also known that an oil level can be increased by increasing the oil volume involved in the circulation. For this purpose, for example, the internal oil pan of the internal combustion engine is connected to an additional oil reservoir, e.g. in the form of oil tanks.

However, in the operation of available oil supply systems with additional oil tanks, it has been found that oil taken via extracting lines from additional oil tanks often has only experienced a short dwell time in the additional oil tank prior to removal.

The object of this invention is therefore to provide an oil supply system with which the residence time of the oil in the additional oil reservoir is extended.

This object is achieved by an oil supply system with the features of claim 1. Advantageous developments are indicated in the dependent claims.

By placing a removal opening of the return line near the base or in the base of the at least one oil tank, a better mixing of the oil in the additional oil tank and a prolonged dwell time in the additional oil tank prior to removal are provided. This ensures that unused (fresh) oil is removed via the return line.

It is preferably provided that the return line is connected to a removal line which extends to the base of the at least one oil tank, whereby the removal line has a removal opening near the base of the at least one oil tank. This describes the case where the removal of oil from the oil tank is performed by means of a separate removal line extending into the oil tank. Alternatively, it can be provided that the removal is performed through an opening in the base of the oil tank. However, due to the accumulation of deposits in the base of the oil tank, it is preferable to perform a removal via a removal line extending to the base of the at least one oil tank.

It is preferably provided that the supply line opens near the base of the at least one oil tank. This measure results in a favorable flow through and mixing of the oil tank, since the oil originating from the internal combustion engine enters at high temperature and charged with gas. Thus, it has the tendency to ascend in the oil tank. When the supply line opens near the base of the at least one oil tank, the ascending oil causes the circulation of the oil volume in the oil tank.

It may be provided that at least one flow guide device is provided in the at least one oil tank. This measure further improves the throughflow in the oil tank. The flow guide device can be designed e.g. in the form of guide plates.

It is preferably provided that a vent line is provided which connects the oil reservoir to a return line. This measure makes it possible to remove the gases dissolved in the oil originating from the internal combustion engine from the oil tank. This measure is important, because otherwise the pressure in the oil tank may increase and thus the oil tank may be partly emptied into the oil pan. The venting can now take place such that a vent line is connected to a return line near the cover of the oil tank. In this case, the gases, together with the recycled oil for the return line, are introduced into a crankcase of the internal combustion engine.

It can be provided that the removal line has at least one venting hole near the cover of the oil tank. This additional or alternative venting measure ensures that no gases are collected in the oil tank, and that they are removed from the oil tank via the removal line.

It is preferably provided that a preferably spring-loaded non-return valve is installed in the supply line between the internal combustion engine and the oil reservoir.

A non-return valve prevents the oil from the oil lines of the internal combustion engine or oil from the oil pan from being emptied into the oil reservoir when the internal combustion engine is at a standstill. In general, the internal combustion engine and the external oil reservoir arranged outside the internal combustion engine are set up on the same structural level.

It may be provided that at least two serially arranged oil tanks are present, whereby the feed line opens into a first oil tank and the at least two oil tanks are connected via connecting lines. This describes the case in which the external oil reservoir is implemented in the form of a plurality of series-arranged oil tanks. In the case of the connection line between individual oil tanks, the measure is also taken that the removal opening of the connecting line is located near the base of the upstream oil tank. The return line to the internal combustion engine is then connected to at least the second oil tank.

If only one oil tank is provided, the return line is connected to the at least one oil tank.

The invention is particularly suitable for stationary internal combustion engines, in particular with a generator to internal combustion engines coupled to a genset.

The invention is particularly suitable for applications of internal combustion engines with high oil wear, e.g. in the case of power-boosting engines with unchanged oil volume, in biogas or landfill gas applications, or engines with small internal oil pans due to their construction.

The invention has proven to be particularly favorable in connection with the use of steel pistons.

The invention is explained in more detail with reference to the figures.

FIG. 1 shows an exemplary embodiment of an oil supply system according to the invention. It shows an internal combustion engine 1 with an internal oil pan 2. The oil supply system shown has a forced-feed lubrication 10.

In this simplified illustration, the forced-feed lubrication 10 comprises the oil pan 2, an oil pump 11, a main oil line 14 and an oil filter 12. The oil O is fed via the main oil line 14 to the consumers 13 in the internal combustion engine 1.

In the exemplary embodiment shown, a supply line 4 branches off from the main oil line 14 upstream of the oil filter 12 and feeds a partial flow of oil O into an external oil reservoir 3, in this case formed by two serially arranged oil tanks 7.

The oil reservoir 3 can, of course, also be formed of only a single oil tank 7. The oil level of the oil O in the two oil tanks 7 is indicated by the shaded area. Preferably, the oil level reaches as far as the lid of the oil tank 7.

From the second oil tank 7 located downstream of the first oil tank 7, the oil O is fed back to the internal combustion engine 1 via a return line 6.

In the exemplary embodiment shown, the supply line 4 leads to the first of the two series-arranged oil tanks 7 and opens into a filling opening 5 near the base of the oil tank 7.

A flow guide device 15, here in the form of a guide plate, can be provided to further improve the throughflow of the oil tank 7.

In the exemplary embodiment shown of two series-connected oil tanks 7, a connecting line 19 is provided between the oil tanks 7. In this case, a first removal line 9 leads via the connecting line 19 into the downstream oil tank 7. The removal opening 8 of the removal line 9 opening into the connection line 19 is arranged near the base of the oil tank 7.

If only one oil tank 7 is provided, the connecting line 19 is not included and the removal line 9 is connected directly to the return line 6.

The removal opening 8 of the removal line 9 is arranged near the base of the oil tank 7.

This results in favorable mixing of the oil O in the additional oil tank 7 (or the additional oil tank 7) and a prolonged dwell time of the oil O in the additional oil tank 7 before it is removed again and returned to the internal combustion engine 1. Thus, fresh oil O is always taken out of the oil tank 7 or the oil tank 7 via the removal opening 8.

Although not shown here, it is also conceivable for the removal opening 8 to be designed as an opening in the base of the oil tank 7, where it opens into the return line 6.

The oil O, charged with gas, enters the oil tank 7 from the internal combustion engine 1 at elevated temperature via the feed line 4 and the filling opening 5. The hot oil O ascends in the oil tank 7 to the surface. By the arrangement of the removal opening 8 near the base of the oil tank 7, on the one hand, good mixing of the oil O in the oil tank 7 is ensured, and on the other hand, it is ensured that non-hot oil just emerging from the internal combustion engine 1 is removed and fed back to the internal combustion engine 1.

The gas G dissolved in the oil O is separated from the oil O in the oil tank 7 and ascends to the surface. So that the pressure in the oil tank 7 does not rise, a vent line 16 is provided, which feeds the gas G to the return line 6. In this way, it passes again into a crankcase 20 of the internal combustion engine 1. Alternatively or additionally, it can be provided that the removal line 9 has a venting hole 17, via which the gas G can enter the return line 6 (or, in the case of several oil tanks, first into the connecting line 19).

The return line 6 opens into the crankcase 20 of the internal combustion engine 1, preferably above the oil level of the oil O in the oil pan 2.

In general, the internal combustion engine 1 and the external oil reservoir 3 arranged outside the internal combustion engine 1are set up on the same structural level. It may be the case that when the internal combustion engine 1 and the oil reservoir 3 are installed, the oil pan 2 rises above a reference level in the oil tank 7. This can lead to a leakage of oil O from the oil lines in the internal combustion engine 1 or a leakage of oil O from the oil pan 2 into the oil tank 7. A leakage from the oil lines when the internal combustion engine 1 is at a standstill, e.g. lines between the main oil line 14 and the consumers 13, is particularly unfavorable, because a pre-lubrication process is thus significantly prolonged before the internal combustion engine 1is started. In a pre-lubrication process, oil O is supplied to the consumers 13 before starting the internal combustion engine 1. The pre-lubrication is usually performed by a pre-lubrication pump 21, which is designed to perform well under the oil pump 11 and bridges it during the pre-lubrication process. The pre-lubrication pump 21 provides e.g. 0.8 bar of oil pressure.

A preferably spring-loaded non-return valve 18 prevents the oil O from the oil lines and oil pan 2 from being emptied into the oil reservoir 3 when the internal combustion engine 1 is at a standstill. A further particular advantage of a spring-loaded non-return valve 18 is that it remains closed in the pre-lubrication process, and thus the oil O in the pre-lubrication process only needs to be pumped through the internal combustion engine 1 and not through the entire oil reservoir 3.

The situation will be shown by means of a numerical example:

The external oil reservoir 3 is supplied with oil O by the supply line 4 via the main oil line 14. Upstream of the oil filter 12 with a pressure of 3 to 10 bar, a cross-sectional taper of the supply line 4 versus the main oil line 14 to a cross-section of 2.5 mm produces an oil flow of 6 l/min at an oil pressure of 4.2 bar at the removal point in the supply line 4. The circulation capacity of the oil pump 11 is 480 l/min. The temperature of the oil O emerging from the oil pan 2 is around 70° C. The pre-lubrication pump 21 provides e.g. 0.8 bar of oil pressure. The opening pressure of the non-return valve 18 is designed to be e.g. 1 bar.

The pressure of the pre-lubrication pump 21 is then below the opening pressure of the non-return valve 18.

The oil reservoir 3 has approximately the same oil volume as the oil pan 2. The oil volume involved in the oil circulation is thus doubled by the oil reservoir 3.

LIST OF REFERENCE SIGNS

1 Internal combustion engine
2 Internal oil pan
3 External oil reservoir
4 Supply line
5 Filling opening
6 Return line
7 Oil tank
8 Removal opening
9 Removal line
10 Pressure circulation lubrication
11 Oil pump
12 Oil filter
13 Consumers
14 Main oil line
15 Flow guide device
16 Vent line
17 Vent hole
18 Non-return valve
19 Connecting line
20 Crankcase
21 Pre-lubrication pump
O Oil
G Gas

What is claimed is:

1. A system, comprising: an oil supply system for an internal combustion engine having an internal oil pan in the internal combustion engine, wherein the oil supply system comprises: an external oil reservoir, comprising a first oil tank and a second oil tank in series and fluidly coupled together with a connecting line; a main oil line configured to couple to the internal oil pan and to the internal combustion engine, wherein the main oil line is configured to circulate oil from the internal oil pan to the internal combustion engine; a supply line coupled to the external oil reservoir and to the main oil line; and a return line configured to connect directly to a crankcase of the internal combustion engine and connected to at least the second oil tank of the external oil reservoir, wherein the oil supply system is configured to flow the oil from the external oil reservoir to the crankcase of the internal combustion engine.

2. The system according to claim 1, wherein a removal line extends to near a base of at least one of the first oil tank or the second oil tank, wherein the removal line has a removal opening near the base.

3. The system according to claim 1, wherein the supply line opens near the first oil tank.

4. The system according to claim 1, wherein at least one flow guide is disposed in the first oil tank.

5. The system according to claim 1, wherein a vent line connects the external oil reservoir to the return line.

6. The system according to claim 2, wherein the removal line has at least one vent hole near a cover of the at least one of the first oil tank or the second oil tank.

7. The system according to claim 1, comprising a spring-loaded non-return valve in the supply line between the internal combustion engine and the external oil reservoir.

8. The system according to claim 1, wherein a first removal line is disposed in the first oil tank and a second removal line is disposed in the second oil tank, wherein the connecting line is coupled to the first removal line, and the return line is coupled to the second removal line.

9. The system according to claim 1, comprising: an oil pump coupled to the main oil line and configured to circulate oil from the internal oil pan to the internal combustion engine; a bypass line coupled to the main oil line at a first location and a second location; and a pre-lubrication pump coupled to the bypass line and fluidly coupled to the main oil line upstream from the oil pump and configured to circulate the oil from the internal oil pan to the internal combustion engine.

10. The system according to claim 1, comprising the internal combustion engine.

11. An oil supply system for an internal combustion engine, comprising:

an internal oil pan configured to couple to the internal combustion engine;

a first external oil tank fluidly coupled to the internal oil pan;

a second external oil tank fluidly coupled to the first external oil tank, wherein the first external oil tank and the second external oil tank are in series and aligned on a horizontal plane;

a supply line coupled to the first external oil tank; and a return line configured to couple to the internal combustion engine and to the second external oil tank, wherein oil is configured to flow from the second external oil tank to the internal combustion engine.

12. The oil supply system according to claim 11, comprising a connecting line configured to fluidly couple the first external oil tank and the second external oil tank, wherein the connecting line comprising an inlet within the first external oil tank, and wherein the inlet is proximate a first bottom of the first external oil tank.

13. The oil supply system according to claim 12, wherein the connecting line comprises an outlet within the second external oil tank, wherein the outlet is proximate a second bottom of the second external oil tank.

14. The oil supply system according to claim 11, comprising a vent line configured to couple to the first external oil tank and to the return line.

15. The oil supply system according to claim 11, comprising a flow guide device within the first external oil tank.

16. An oil supply system for an internal combustion engine, comprising:

an internal oil pan in the internal combustion engine;

an external oil reservoir fluidly coupled to the internal oil pan;

a main oil line coupled to the internal oil pan and to the internal combustion engine;

an oil pump coupled to the main oil line and configured to circulate oil from the internal oil pan to the internal combustion engine;

a bypass line coupled to the main oil line at a first location and a second location;

a pre-lubrication pump coupled to the bypass line and fluidly coupled to the main oil line upstream from the oil pump and configured to circulate the oil from the internal oil pan to the internal combustion engine;

a supply line coupled to the external oil reservoir and to the main oil line; and a return line coupled to the internal combustion engine and to the external oil reservoir, wherein the oil is configured to flow through the return line from the external oil reservoir to the internal combustion engine.

17. The oil supply system according to claim 16, comprising a spring-loaded non-return valve in the supply line between the internal combustion engine and the external oil reservoir.

18. The oil supply system according to claim 17, wherein the spring-loaded non-return valve has a spring force greater than an oil pressure generated by the pre-lubrication pump.

19. The oil supply system according to claim 16, wherein the external oil reservoir comprises a first oil tank and a second oil tank.

20. The oil supply system according to claim 19, wherein the first oil tank and the second oil tank are in series and are fluidly coupled together with a connecting line.

* * * * *